US009109422B2

(12) United States Patent
Ferguson et al.

(10) Patent No.: US 9,109,422 B2
(45) Date of Patent: Aug. 18, 2015

(54) BALL INJECTOR SYSTEM APPARATUS AND METHOD

(71) Applicant: Performance Wellhead & Frac Components, Inc., Houston, TX (US)

(72) Inventors: Gerry M. Ferguson, Houston, TX (US); Wilson P. Acosta, Jr., Lafayette, LA (US)

(73) Assignee: PERFORMANCE WELLHEAD & FRAC COMPONENTS, INC., Houston, TX (US)

( * ) Notice: Subject to any disclaimer, the term of this patent is extended or adjusted under 35 U.S.C. 154(b) by 316 days.

(21) Appl. No.: 13/896,962

(22) Filed: May 17, 2013

(65) Prior Publication Data

US 2014/0262302 A1 Sep. 18, 2014

Related U.S. Application Data

(60) Provisional application No. 61/790,569, filed on Mar. 15, 2013.

(51) Int. Cl.
*E21B 33/068* (2006.01)

(52) U.S. Cl.
CPC ..... *E21B 33/068* (2013.01)

(58) Field of Classification Search
CPC ..... E21B 33/068
See application file for complete search history.

(56) References Cited

U.S. PATENT DOCUMENTS 4,759,469 A * 7/1988 Lowrance et al. ..... 221/75
5,004,048 A 4/1991 Bode
6,302,199 B1 10/2001 Hawkins et al.
7,364,051 B2 4/2008 Diaz et al.
7,552,763 B2 6/2009 Claxton
7,571,773 B1 8/2009 West et al.
8,136,585 B2 3/2012 Cherewyk
8,256,514 B2 9/2012 Winzer
8,256,515 B2 9/2012 Barbee
2008/0223587 A1 9/2008 Cherewyk (Continued)

FOREIGN PATENT DOCUMENTS

CA 2739411 8/2012

OTHER PUBLICATIONS

Hakami, et al., Innovative Process to Ensure Efficient Multiple Stage Fracturing Treatments, Abu Dhabi International Petroleum Conference and Exhibition, Nov. 11-14, 2012, Abu Dhabi, UAE.

(Continued)

*Primary Examiner* — William P Neuder
(74) *Attorney, Agent, or Firm* — David L. Odom

(57) ABSTRACT

A ball launching system includes a ball launcher with a removable ball pod and sleeve assembly that retains balls prior to injection. An interchangeable ball pod with a chamber corresponding to the ball diameter, fits into a pod sleeve and comprise the ball pod and sleeve assembly. The ball launcher further includes a housing with a moveably disposed piston that engages with the ball thereby launching it. The housing also includes a thru hole through which the piston may travel to externally indicate its position within the housing. The ball launching system also includes a control system having control inputs, which may be located remote to the ball launcher. By applying a pre-determined sequence of control inputs, the piston may engage with the balls retained in the ball pod and sleeve assembly to force the balls to be launched from the ball launcher.

19 Claims, 6 Drawing Sheets

(56) References Cited

U.S. PATENT DOCUMENTS

| | | | |
|---|---|---|---|
| 2012/0152525 | A1 | 6/2012 | McGuire et al. |
| 2012/0211219 | A1 | 8/2012 | McGuire et al. |
| 2012/0234534 | A1 | 9/2012 | Hughes et al. |
| 2012/0279717 | A1 | 11/2012 | Young et al. |
| 2013/0014936 | A1 | 1/2013 | Griffith |
| 2013/0032327 | A1 | 2/2013 | He et al. |

OTHER PUBLICATIONS

Durst, et al., Improved Single-Trip Multistage Completion Systems for Unconventional Gas Formations, SPE Tight Gas Completions Conference, Jun. 9-11, 2008, San Antonio, TX, USA.

* cited by examiner

BALL INJECTOR SYSTEM APPARATUS AND METHOD

CROSS-REFERENCE TO RELATED APPLICATIONS

This application claims the benefit of U.S. Provisional Application No. 61/790,569, filed Mar. 15, 2013. This application incorporates by reference the entirety of U.S. Provisional Application No. 61/790,569.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

This invention generally relates to equipment used for well completion, re-completion, or workover. In particular, this invention relates to frac ball injector assemblies and control systems used to drop or launch frac balls into a wellbore to facilitate completion operations for oil and gas wells.

2. Description of Related Art

Hydraulic fracturing ("fracing") is a commonly used technique to increase the production of oil and natural gas wells. In combination with horizontal drilling, this technique allows manufacturers to extract large amounts of hydrocarbons stored within shale in an economically feasible manner. Prior to the fracing process, a drilling company will typically drill a hole first vertically several thousand feet to the depth of the gas and oil bearing reservoir and then horizontally along the shale layer. Subsequently, the wells are lined with steel pipe ("casing") that is inserted into the well bore. The casing is perforated at target zones so that a liquid can be injected at high pressures into the surrounding shale such that the liquid creates small cracks or fractures in the shale to expose the trapped hydrocarbons. The shale is typically fractured in sections, with the horizontal area furthest from the well bore being fractured first. Subsequently, that section is isolated and the next section is fractured. In this way, through multiple fracturing and isolation steps, i.e., multi-stage fracing, the complete horizontal section is fractured from the end of the well to a predetermined location closest to the well bore.

One method of isolating various sections or exposing perforations in the casing to accomplish multi-stage fracing is by using frac-balls. Frac-balls are spheres made of various materials such as ceramic, G10/FR4, a thermosetting industrial fiberglass composite laminate, or injection molded composite thermoplastic or phenolic resin. The balls are launched from the surface into the well bore in a predetermined order and land in seats, having a diameter smaller than that of the ball, at predetermined locations in the pipe. The balls isolate a portion of the well that has already been fractured by preventing or restricting incoming fluid from reaching those portions of the well. Further, by seating the balls in sleeves the seats can be translated to expose perforations in a portion of the liner. These perforations allow fracing fluids to be injected into that portion of the well behind the ball to fracture those regions of shale.

Typically, the well is fractured starting with the horizontal region furthest away from the vertical well bore, working back towards the surface. Multiple balls can be launched in one completion operation. One or multiple balls having a small diameter are first launched, isolating the first portion of the well and/or opening perforations. Following the fracturing operation of that portion of the well, balls having increasing diameter are subsequently, sequentially launched, and fracturing operation of the remaining portions are conducted in the same completion operation.

While it is possible to manually drop a ball into the fluid flow, this method is time consuming, prone to human error, and requires workers to be located close to high-pressure areas, thereby presenting safety concerns. Ball launchers, affixed to the well, allow balls to be preloaded and subsequently injected into the fluid flow, to be carried into the well. Multiple ball launchers can be used in a multi-step fracturing operation without breaking high-pressure connections, allowing completion operations to proceed efficiently. However, inadvertent launching of a ball or improper sequencing of the balls remains a problem. Balls launched improperly can result in additional time and expense for removing the ball and reworking well completion operations.

Thus, there is a need in the art for a reliable frac ball launching unit capable or launching multiple balls while reducing the possibility of inadvertent or improper launching or improper sequencing of balls.

SUMMARY OF THE INVENTION

In accordance with the teachings provided herein for launching frac balls, one example provides a ball pod apparatus. The apparatus comprises a ball pod sleeve having an axial sleeve bore, a ball pod disposed within the axial sleeve bore and having a cylindrical ball pod bore, a ball pod cover removably attached to the ball pod sleeve, and a retainer within the cylindrical ball pod bore wherein the retainer prevents undesired gravity exit of a frac ball from the cylindrical ball pod bore.

In another example, a frac ball launching apparatus for injecting a frac ball into well piping is provided comprising a ball pod housing having a ball pod bore and a ball pod apparatus further comprising a ball pod sleeve having an axial sleeve bore and a ball pod adapted to retain a frac ball disposed within the axial sleeve bore. The ball pod apparatus is disposed within the ball pod bore. The frac ball launching apparatus further comprises a hydraulic housing removably engaged with the ball pod housing comprising a piston assembly operationally disposed within the hydraulic housing and a passage for the piston assembly to travel within the hydraulic housing wherein the piston assembly is adapted to engage with the frac ball to inject the frac ball from the frac ball launching apparatus into the well piping.

In another example, a method of configuring a frac ball launching apparatus is provided comprising providing at least one ball launcher itself comprising a ball pod housing having a ball pod bore and a ball pod apparatus. The ball pod apparatus comprises a ball pod sleeve having a sleeve bore and a first ball pod adapted to retain a frac ball of a first diameter wherein the ball pod is disposed within the sleeve bore, wherein the ball pod apparatus is disposed within the ball pod bore. The method of configuring a frac ball launching apparatus further comprises steps of providing a second ball pod adapted to retain a frac ball of a second diameter wherein the second diameter can be the same or different from the first diameter, removing the first ball pod disposed within the sleeve bore, and inserting the second ball pod within the sleeve bore.

In another example, a frac ball launching system for injecting balls into a well bore is provided comprising at least one ball launcher further comprising a ball pod housing having a ball pod bore, a ball pod apparatus wherein the ball pod apparatus is disposed within the ball pod bore, a hydraulic housing, and a frac ball control system. The ball pod apparatus further comprises a ball pod sleeve having an axial sleeve bore and a ball pod adapted to retain a frac ball disposed within the axial sleeve bore, wherein the ball pod apparatus is disposed within the ball pod bore. The hydraulic housing is removably engaged with the ball pod housing and further comprises a piston assembly operationally disposed within the hydraulic housing and a passage for the piston assembly to travel within the hydraulic housing. The frac ball control system further comprises at least one control switch and at least one safety switch wherein simultaneously depressing the control switch and the safety switch causes the piston assembly to engage with a frac ball to inject the frac ball from the at least one ball launcher into the well bore.

In yet another example, a method of injecting frac balls into a flow passage is provided comprising providing at least one ball launcher and a frac ball control system comprising at least one control switch and activating the at least the control switch to inject the frac ball from the at least one ball launcher into the flow passage. The at least one ball launcher further comprises a ball pod housing having a ball pod bore, a ball pod apparatus, a hydraulic housing removably engaged with the ball pod housing, and a frac ball control system. The ball pod apparatus further comprises a ball pod sleeve having a sleeve bore and a ball pod adapted to retain a frac ball disposed within the sleeve bore, wherein the ball pod apparatus is disposed within the ball pod bore. The hydraulic housing further comprises a piston assembly operationally disposed within the hydraulic housing and a passage for the piston assembly to travel within the hydraulic housing. The frac ball control system further comprises at least one control switch wherein activating the control switch engages the piston assembly to engage with a frac ball to inject the frac ball from the at least one ball launcher into the flow passage.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, certain embodiments of the present disclosure are shown in the drawings. It should be understood, however, that the invention is not limited to the precise arrangements and instrumentalities shown. The accompanying drawings, which are incorporated in and constitute a part of this specification, illustrate an implementation of system, apparatuses, and methods consistent with the present invention and, together with the description, serve to explain advantages and principles consistent with the invention.

DETAILED DESCRIPTION OF THE INVENTION

Figure 1:
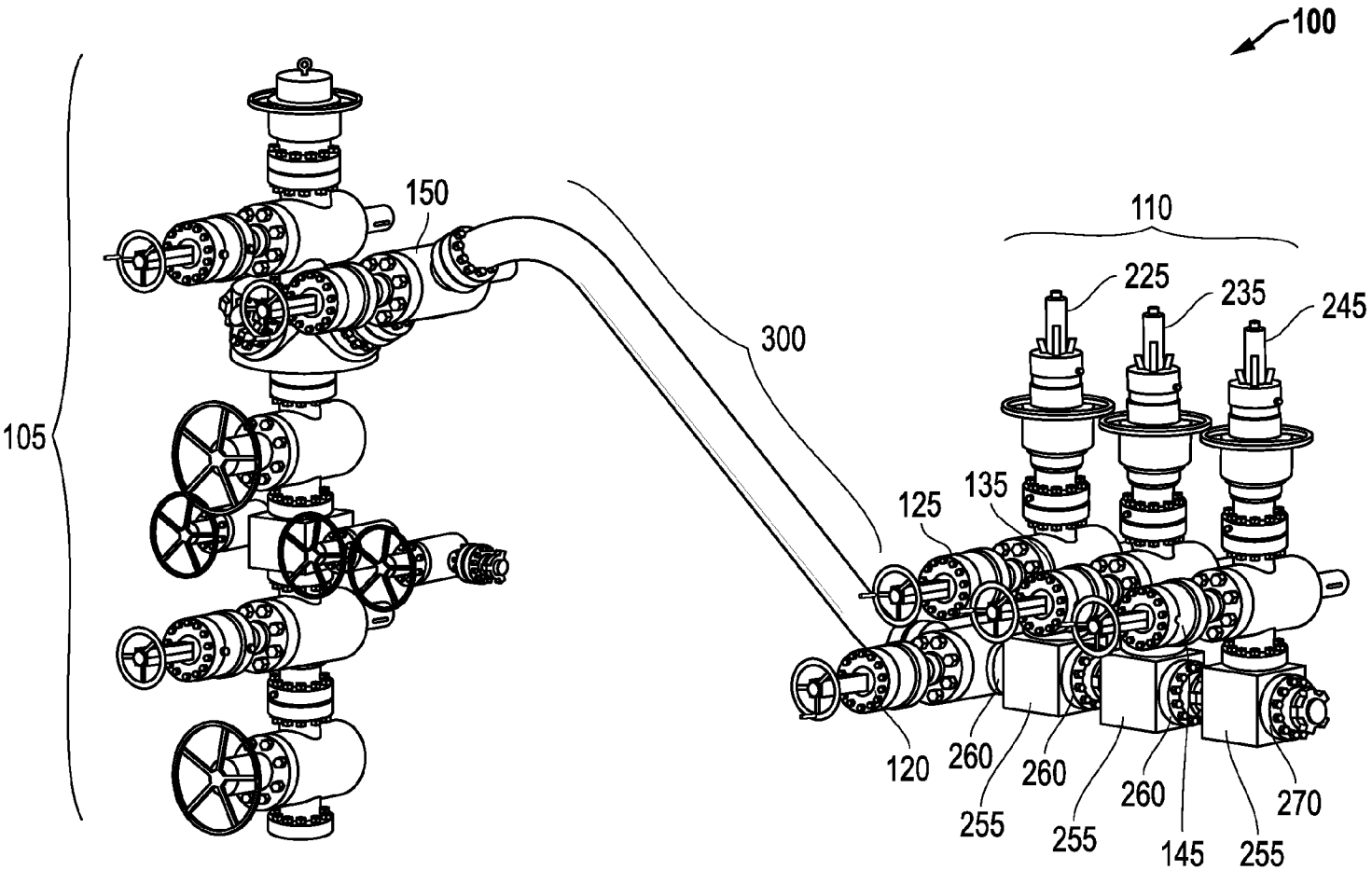
FIG. 1 illustrates a perspective view of one embodiment of a mechanical frac ball system and apparatus with ball launchers located remote to a well head.

Before explaining at least one embodiment of the invention in detail, it is to be understood that the invention is not limited in its application to the details of construction and to the arrangements of the components set forth in the following description or illustrated in the drawings. The Figures and written description are provided to teach any person skilled in the art to make and use the inventions for which patent protection is sought. The invention is capable of other embodiments and of being practiced and carried out in various ways. Those skilled in the art will appreciate that not all features of a commercial embodiment are shown for the sake of clarity and understanding. Persons of skill in the art will also appreciate that the development of an actual commercial embodiment incorporating aspects of the present inventions will require numerous implementation—specific decisions to achieve the developer's ultimate goal for the commercial embodiment. While these efforts can be complex and time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity in specific reference to the Figures and are not intended to limit the scope of the invention or the appended claims. Further, it should be understood that any one of the features of the invention can be used separately or in combination with other features. Other systems, methods, features, and advantages of the invention will be or become apparent to one with skill in the art upon examination of the Figures and the detailed description. It is intended that all such additional systems, methods, features, and advantages be included within this description, be within the scope of the present invention, and be protected by the accompanying claims.

Reference will now be made in detail to an implementation consistent with the present invention as illustrated in the accompanying drawings. For the purpose of clarification, embodiments described herein reference the term "fluid," which refers to a gas, liquid, as well as liquid solution with solid aggregates, as well as any material that can reasonably be expected to flow.

Referring to FIG. 1, by way of non-limiting example, and consistent with embodiments of the invention, a frac ball launching unit 100 is shown. The frac ball launching unit 100 includes a well head unit 105 located at and coupled to a well bore (not shown) and a remote unit 110 located a pre-determined distance such as but not limited to one-hundred and fifty (150) feet, away from the well bore. The remote unit 110 can be located in a region safely away from the high pressure well bore. Further, the remote unit 110 is coupled to the well head unit 105 through a connection tubing 300. The connection tubing 300 allows fluid to be carried between the remote unit 110 and the well head unit 105.

The remote unit 110 is comprised of a remote isolation gate valve 120, ball launcher isolation gate valves 125, 135, 145 and ball launchers 225, 235, 245. The remote isolation gate valve 120 and multiple ball launcher isolation gate valves 125, 135, 145 open to allow passage of fluids and/or frac balls through the remote isolation gate valve 120 and multiple ball launcher isolation gate valves 125, 135, 145 or close to isolate one side of the remote isolation gate valve 120 and multiple ball launcher isolation gate valves 125, 135, 145 from another. When closed, the remote isolation gate valve 120 isolates the remote unit 110 from a connection tubing 300 and a well head unit 105. Each ball launcher 225, 235, 245 is coupled to its respective ball launcher isolation gate valve 125, 135, 145 by way of flanges on each ball launcher 225, 235, 245 and ball launcher isolation gate valve 125, 135, 145. By closing each ball launcher isolation gate valves 125, 135, or 145, the respective ball launchers 225, 235, or 245 can be isolated from portions of the frac ball launching unit 100. In a process to be described below, once an individual ball launcher 225, 235, 245 is isolated, the ball launchers 225, 235, 245 can be easily disassembled in the field to provide access as needed. This allows additional frac-balls to be added or the frac-ball size to be changed. By opening each ball launcher isolation gate valves 125, 135, or 145, the respective ball launcher 225, 235, or 245 can be functionally exposed to the connection tubing 300 and the well head unit 105 of the frac ball launching unit 100 to subsequently launch a frac ball.

The ball launcher isolation gate valves 125, 135, 145 are connected to T-fittings 255 which are themselves connected to each other through spacers 260. Both the T-fittings 255 and spacers 260 have flanges, which allow them to make sealed connections. The spacers 260 provide separation between the T-fittings 255, which can be necessary to attach one T-fitting 255 to another or to attach one T-fitting 255 to the remote isolation gate valve 120. The embodiment shown in FIG. 1 has an assembly comprising a serial coupling of multiple ball launchers 225, 235, 245 through their respective ball launcher isolation gate valves 125, 135, 145. This assembly is coupled to one end to the connection tubing 300 through the remote isolation gate valve 120. The other end of the assembly is attached to a cross-over fitting 270.

The cross-over fitting 270 allows external access to the remote unit 110. The cross-over fitting 270 allows piping (not shown) to be connected to the remote unit 110 so that fluid can be pumped, as a non limiting example, at a rate of about 6-8 barrels per minute, into the remote unit 110 and from there into the well head unit 105 through the connection tubing 300. This fluid carries a launched frac-ball from the remote unit 110 to the well head unit 105 where it will subsequently be carried into the well bore (not shown) and well piping (not shown) by pumped fluid. The cross-over fitting 270 typically comprises two types of fittings to mate from a pipe fitting, as an example but not limited to a WECO fitting, to the flange connections on the T-fitting 255. One of skill in the art will recognize that a cross-over fitting 270 is only necessary if a transforming connection from external piping to the frac ball launching unit 100 is needed.

Although three ball launchers 225, 235, 245 are shown in the embodiment presented in FIG. 1, one of skill in the art will understand that any different number of ball launchers 225, 235, 245 can be attached as needed, in substantially the same manner described. One of skill in the art will also recognize that a single ball launcher 225 can be used in the remote unit 110. Further, one of skill in the art will recognize that numerous connections are possible using T-fittings 255 and spacers 260. The T-fittings 255 allow the ability to expand the number of ball launchers 225, 235, 245 that can be assembled by providing three flanges on the various faces of the T-fittings 255. One of skill in the art will recognize that T-fittings 255 with additional faces could be used to connect spacers 260, ball launchers 225, 235, 245, and ball launcher isolation gate valves 125, 135, 145. Further, other methods of connection known by those of skill in the art can be utilized as required for a particular operation. As a non-limiting example, the ball launchers 225, 235, 245 can be connected in parallel. As another non-limiting example, the embodiment presented in FIG. 1 can use a single ball launcher isolation gate valve 125 to isolate multiple ball launcher 225, 235, 245. Further T-fittings 255 can be designed so that spacers 260 are not needed to connect T-fitting 255 or remote isolation gate valve 120 or ball launcher isolation gate valves 125, 135, 145, or ball launchers 225, 235, 245 in the frac ball launching unit 100.

The frac ball launching unit 100 is designed to support the largest frac-ball that will be launched. The T-fittings 255 and spacers 260 have an interior cavity whose dimensions are such that the largest injected frac-ball from a ball launcher 225, 235, 245 can easily travel through it. Similarly, the diameters of the ball launcher isolation gate valves 125, 135, 145 are large enough to allow travel of injected balls 550 (see FIGS. 3 and 4) without undue restriction. Further, the connection tubing 300 should have a diameter such that the largest injected ball 550 in the remote unit 110 can travel to the well head unit 105 unrestricted.

At the well head unit 105 side of the connection tubing 300, a tubing isolation gate valve 150 isolates the connection tubing 300 from the well head unit 105. Isolating the connection tubing 300 and remote unit 110 from the pressurized well head unit 105 allows the remote unit 110 to be safely modified or serviced without disturbing other operations at the well head unit 105. As a non-limiting example, the remote isolation gate valve 120 along with the tubing isolation gate valve 150 allow operators the capability of loading and reloading the various stages of ball launchers 225, 235, 245 while other well stimulation/completion operations are ongoing.

Figure 2:
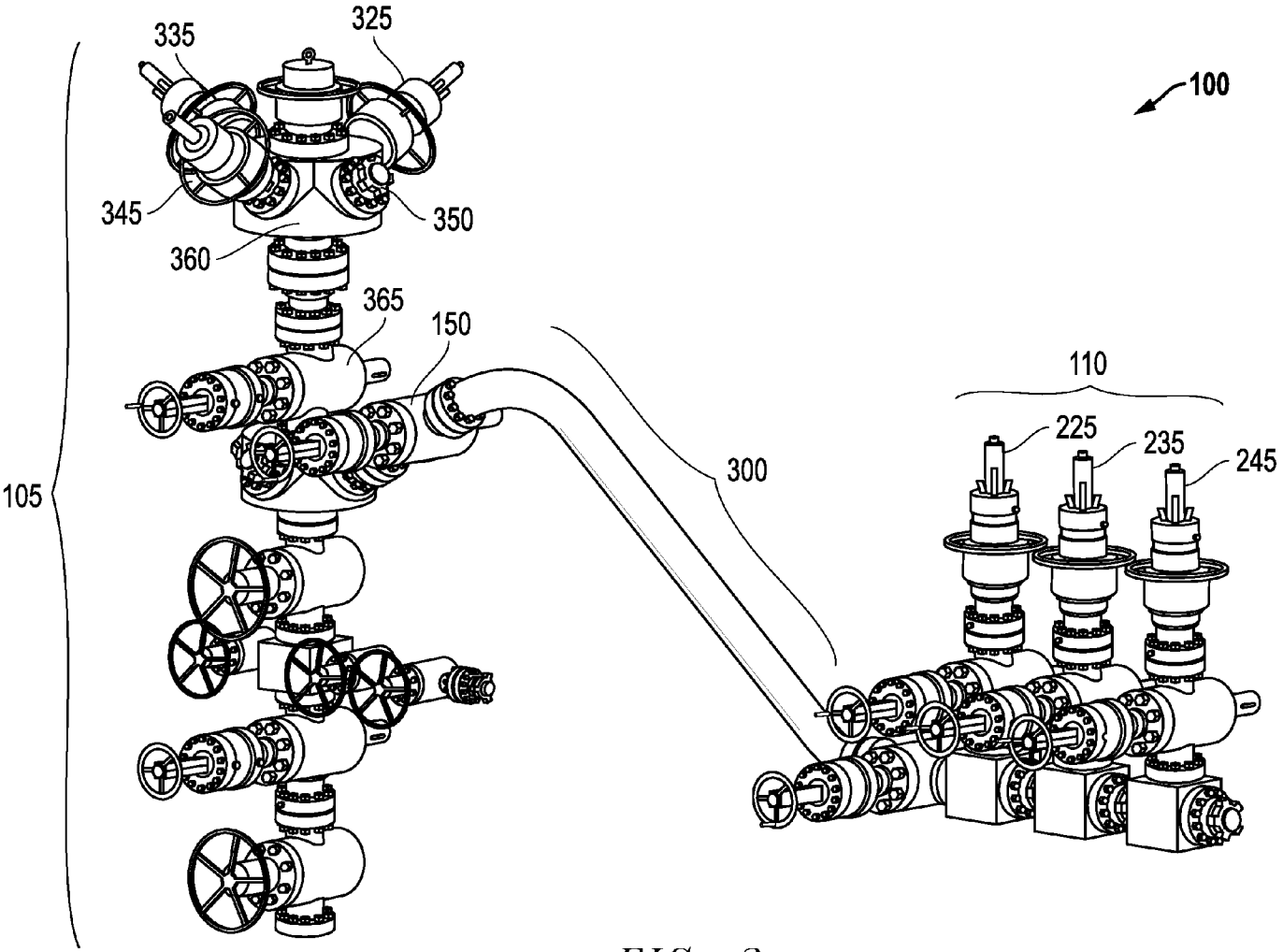
FIG. 2 illustrates a perspective view of a second embodiment of a mechanical frac ball system and apparatus with ball launchers located both remotely and at the well head.

FIG. 2 shows an embodiment of the invention with ball launchers 325, 335, 345 on the well head unit 105. The ball launchers 325, 335, 345 at the well head unit 105 are the same as the ball launchers 225, 235, 245 at the remote unit 110. In this embodiment, the ball launchers 325, 335, 345 are connected to a goat head connection 360 by way of flanges. The goat head connection 360 is also connected to the well head unit 105 by way of a flange. Unused openings on the goat head connection 360 can be sealed using a goat head cap 350. A goat head isolation valve 365 is located between the goat head connection 360 and the remainder of the well head unit 105. The goat head isolation valve 365 can be opened to allow balls 550 to be dropped into the well bore or closed to isolate the ball launchers 325, 335, 345 and the goat head connection 360 from the remainder of the well head unit 105 and well pressures. One of skill in the art will recognize that other connections can be made to the well head unit 105 through the goat head connection 360. One of skill in the art will recognize that a goat head connection 360 is optional when a single ball launcher 325 is used at the well head unit 105. One of skill in the art will recognize that isolation gate valves similar to ball launcher isolation gate valves 125, 135, 145 (as shown in FIG. 1) can be fitted between ball launchers 325, 335, 345 and the goat head connection 360.

Ball launchers 325, 335, 345 are particularly useful, when mounted as shown on the well head unit 105, for those ball diameters where fluid flow from the remote unit 110 cannot easily carry a ball 550 (see FIGS. 3 and 4) to the well head unit 105. By placing ball launchers 325, 335, 345 on the well head unit 105, balls 550 from the ball launchers 325, 335, 345 can be dropped into the fluid flow and carried to the well bore and subsequently to the well. This is typically needed for larger size balls 550, such as but not limited to, larger than three-and-one-half inches, where fluid from the remote unit 110 may not be able to carry the ball 550 from the remote unit 110 to the well bore. However, one of skill in the art will understand that ball launchers 325, 335, 345 can be applied to smaller diameter balls 550. One of skill in the art will also understand that other reasons may exist for placing the ball launchers 325, 335, 345 on the well head unit 105. The frac ball launching unit 100 has been described as having a well head unit 105 and a remote unit 110. One of skill in the art will recognize that the frac ball launching unit 100 can only have only one unit, either the well head unit 105 or the remote unit 110.

Figure 3:
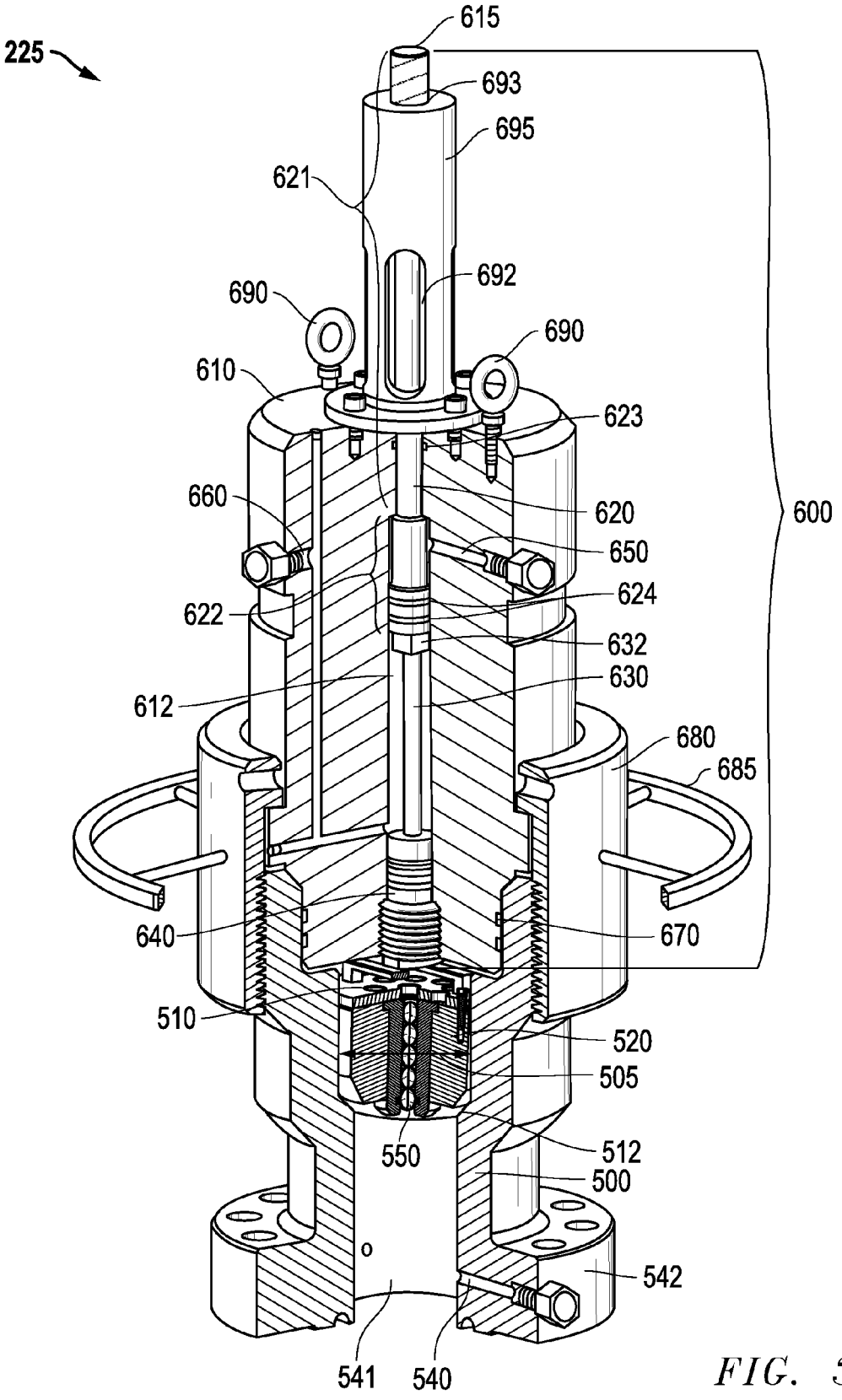
FIG. 3 illustrates a perspective and partial cross-section view of a ball launcher apparatus according to an embodiment of the invention.

FIG. 3 shows details of the ball launcher 225. Note that ball launchers 225, 235, 245, 325, 335, and 345 (shown in FIGS. 1 and 2) are same in operation but can be pre-configured or designed to drop different sizes of balls from each ball launcher 225, 235, 245, 325, 335, and 345. For this reason, described in detail is ball launcher 225 and its description is applicable to other ball launchers 235, 245, 325, 335, 345. Although only ball launcher 225 is described in detail, ball launchers 235, 245, 325, 335, 345 are the same or substantially similar in design or operation. The primary differences between the ball launchers 225, 235, 245, 325, 335, 345 can be in each respective ball pod and sleeve assembly 510 which correspond to the various pre-determined ball 550 diameters to be used in the frac ball launching unit 100 (see FIGS. 1 and 2). One of skill in the art will understand that throughout this description, ball 550 is used to mean single or multiple balls 550. Preferably, if multiple balls 550 are utilized, they would all be of the same pre-determined diameter. However, one of skill in the art will recognize that an embodiment of the described ball launcher 225 would allow for the insertion of balls of multiple diameters.

The ball launcher 225 includes a hydraulic housing assembly 600 comprising a hydraulic housing 610 and a piston assembly 615. The piston assembly 615 comprises a piston 620, a ball rod 630, and a ball rod seal gland 640. The hydraulic housing 610 is designed to house the piston 620 so that it can freely travel within a bore in the hydraulic housing 610 forming a hydraulic housing chamber 612. The piston 620 comprises a lower piston area 622, which typically has a diameter larger than the diameter of the remainder of the piston 620. The lower piston area 622 has a diameter substantially equal but slightly smaller than the diameter of the hydraulic housing chamber 612 so that it is able to move substantially freely within the hydraulic housing chamber 612. The lower piston area 622 also accommodates piston rings 624 to seal the piston 620 within the hydraulic housing chamber 612 and provide a cavity above and below the lower piston area 622 within the hydraulic housing chamber 612. The piston 620 also comprises an upper piston area 621 having a diameter smaller than lower piston area 622. The top portions of the upper piston area 621 travels through a conduit (not shown) at the top of the hydraulic housing 610 and the hydraulic housing chamber 612. An upper piston o-ring 623 forms a seal between the hydraulic housing chamber 612 and the piston 620.

A ball rod 630 of the piston assembly 615 is threadably engaged with the lower piston area 622 of the piston 620. A jam nut 632 threadably engages on the ball rod 630 and is further engaged with the lower piston area 622 to provide resistance to limit the ability of the ball rod 630 from disengaging from the piston 620. The ball rod seal gland 640 has a central bore with an inner seal, such as but not limited to, o-rings to accommodate the ball rod 630. The ball rod 630 travels through the central bore of the ball rod seal gland 640. The ball rod seal gland 640 comprises additional seals such as, but not limited to, o-rings, on the outer face. The ball rod seal gland 640 with its corresponding seals threadably engages with the hydraulic housing chamber 612 such that the hydraulic housing chamber 612 is sealed to withstand hydraulic pressure inside the hydraulic housing chamber 612.

The ball launcher 225 further includes a ball pod housing 500, which is machined to house a corresponding ball pod and sleeve assembly 510. The ball pod housing 500 has an axial bore 541 wherein a ball pod bore diameter 505 is slightly larger than the outer diameter of the ball pod and sleeve assembly 510 such that the ball pod and sleeve assembly 510 matingly engages within the interior of the ball pod housing 500. The ball pod housing 500 has a ball pod ledge 512 with a reduced inner diameter so that the ball pod ledge 512 engages the bottom outer area of the ball pod and sleeve assembly 510 and retains the ball pod and sleeve assembly 510 at a predetermined position within the ball pod housing 500. The ball pod housing 500 also has a bleed port 540, which serves as a conduit through a flange 542 on the ball pod housing 500. The bleed port 540 allows access to the axial bore 541, such as but not limited for relieving inner pressure once the ball launcher 225 is assembled and in operation.

The hydraulic housing 610 matingly engages with the ball pod housing 500. The hydraulic housing 610 comprises a lower portion that has an outer diameter that is slightly smaller than the inner diameter of an upper portion of the ball pod housing 500. The hydraulic housing 610 also comprises housing seal grooves 670 that accommodate housing seals (not shown), such as but not limited to piston seals or o-rings. As the lower portion of the hydraulic housing 610 matingly engages with the upper portion of the ball pod housing 500, the housing seals (not shown) engage with both surfaces to prevent leakage of fluid, such as but not limited to fracing fluid. The ball launcher 225 further has a nut 680 with inner threads that threadably engages with outer threads on the ball pod housing 500. The nut 680 can have ring handles 685 that assist in hand-tightening the nut 680 onto the ball pod housing 500.

The hydraulic housing 610 can further comprise lifting eyes 690 that are threadably engaged with the top of the hydraulic housing 610. The lifting eyes 690 can be used to stabilize the ball launcher 225 during various operations or to assist in lifting the hydraulic housing 610 from the ball pod housing 500. The ball launcher 225 further has a cage 695 that protects the upper piston area 621 as it travels on top of the hydraulic housing 610. The cage 695 engages the hydraulic housing assembly 600 over the conduit at the top of the hydraulic housing 610 and is of sufficient depth to accommodate the travel of the piston 620 outside the hydraulic housing 610.

The cage 695 also has windows 692 that allow the upper piston area 621 to be visible and a top hole 693 so that the upper piston area 621 can emerge from the top hole 693 indicating that the piston 620 is in an upper position in the hydraulic housing chamber 612. This position can indicate that the ball 550 has not yet been launched. When the balls 550 are launched, the piston 620 will travel downwards and the upper piston area 621 may only be visible in the windows 692 of the cage 695, serving as an indication that the ball 550 has been launched.

The hydraulic housing assembly 600 further consists of a right port 650 and a left port 660. The right port 650 comprises a conduit through the wall of the hydraulic housing 610 to the upper portion of the hydraulic housing chamber 612. The left port 660 comprises a conduit through the wall of the hydraulic housing 610 to the lower portion of the hydraulic housing chamber 612. As fluidic pressure is increased in the right port 650, the fluidic pressure will correspondingly increase in the upper portion of the hydraulic housing chamber 612 above the lower piston area 622 and thereby force the piston 620 downward. Similarly, as fluidic pressure is increased in the left port 660, the pressure will increase in the hydraulic housing chamber 612 below the lower piston area 622 and tend to force the piston 620 upward. As a non-limiting example, a typical fluid pressure of about 300 pounds per square inch can be used to move the piston 620 and thereby the piston assembly 615 upwards and downwards. One of skill in the art will recognize that although a hydraulic assembly has been described, other embodiments can utilize a mechanical assembly or electrically assembly to translate the piston assembly 615 within the hydraulic housing chamber 612.

Figure 4:
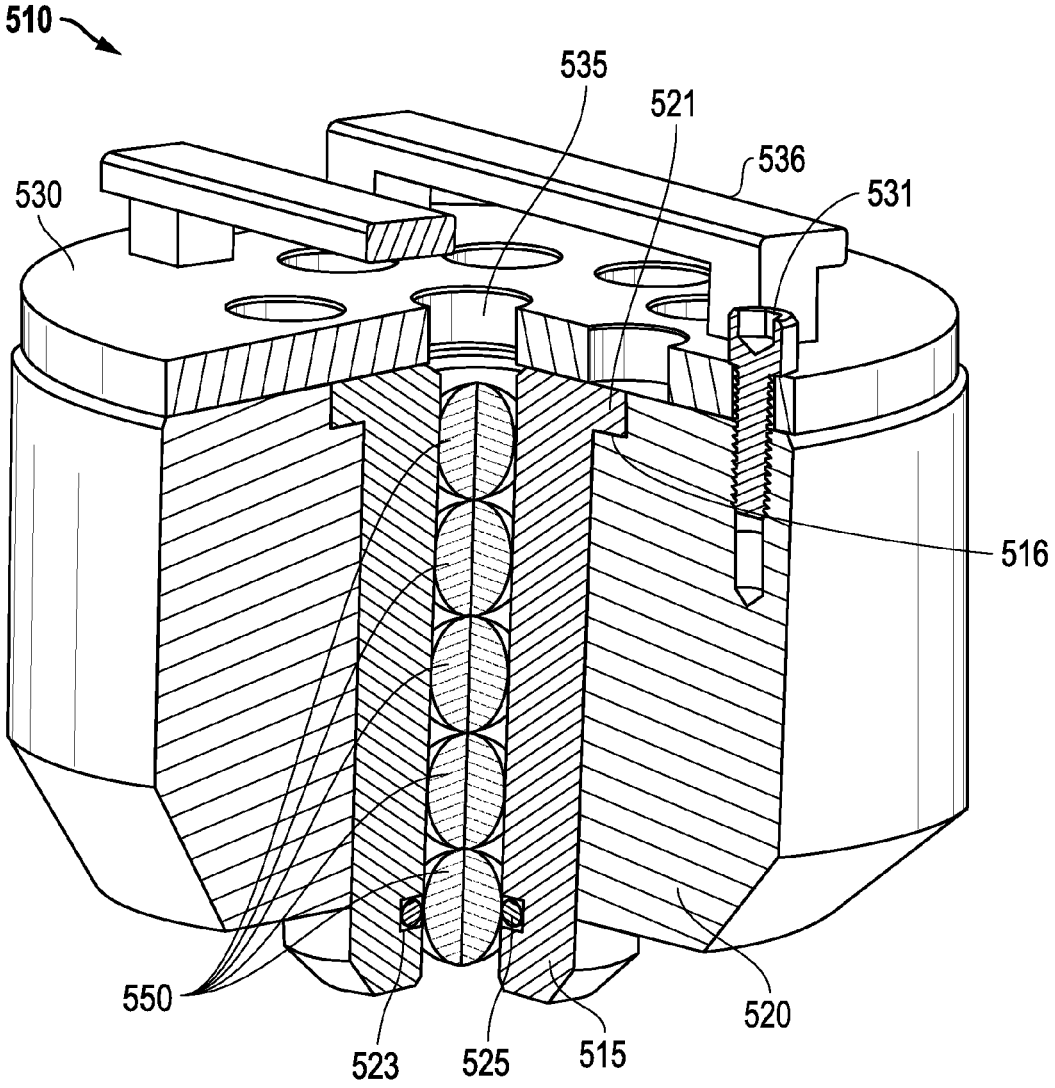
FIG. 4 illustrates a perspective and partial cross-section view of a ball pod housing comprising a pod sleeve and a ball pod according to an embodiment of the invention.

Referring now to FIG. 4, the ball pod and sleeve assembly 510 will now be described. The ball pod and sleeve assembly 510 comprises a ball pod sleeve 520 and a ball pod 515 wherein the pall pod sleeve 520 has an inner diameter substantially similar to the outer diameter of a ball pod 515, which allows for precise mating engagement within the ball pod sleeve 520. The ball pod sleeve 520 comprises a pod ledge 516 fabricated with a diameter that corresponds with outer diameter of a sleeve lip 521 of the ball pod 515. The sleeve lip 521 engages within the pod ledge 516 such that the ball pod 515 is retained within the ball pod sleeve 520 and prevented from sliding further into the ball pod sleeve 520.

The ball pod 515 has an inner diameter that corresponds to the intended pre-selected diameter of balls 550 to be utilized within the ball launcher 225. As a non-limiting example, the pre-selected diameter of the ball 550 can vary from less than one inch up to several inches. Further, single or multiple balls 550 can be utilized in the ball pod 515. By way of non-limiting example, while a ball launcher 225 can only accommodate a single 4 inch diameter ball 550, multiple balls 550 having diameters less than one inch can also be used in the same ball launcher 225 by utilizing an appropriate pre-determined ball pod and sleeve assembly 510 having a pre-determined ball pod sleeve 520 and pre-determined ball pod 515. As the diameter of the ball 550 is varied, the ball pod 515 is correspondingly changed so that the inner diameter of the ball pod 515 is substantially similar to the diameter of the balls 550. A ball pod 515 is designed to accommodate a first ball diameter and is removable from the ball pod sleeve 520 such that the ball pod 515 can be replaced with another ball pod 515 designed to accommodate different diameter balls 550. In this way, the same ball pod sleeve 520 can be used for multiple ball pods 515 and for several ball 550 diameters. Further, a single ball launcher 225 can accommodate various size balls 550 by using the appropriate ball-size specific ball pod 515. As will be understood by one of skill in the art, for a given ball pod sleeve 520, when the walls of the ball pod 515 becomes mechanically incompatible with increasing ball 550 diameter, the ball pod sleeve 520 should be changed to accommodate a larger ball pod 515.

The ball pod 515 further has a pod inner groove 523 which retains a pod o-ring 525. The pod o-ring 525 is typically made of an elastomeric material so that the pod o-ring 525 is compressible. The pod o-ring 525 has an inner diameter that is smaller than the diameter of the corresponding balls 550 in order to retain the balls 550 within the ball pod 515. However, the diameter of the pod o-ring 525 is large enough such that when pressure is placed on the ball 550, the pod o-ring 525 can be compressed sufficiently to eject the ball 550 from the bottom of the ball pod 515. The pod o-ring 525 is one method of retaining the balls 550 within the ball pod 515 and other methods can be utilized and are within the scope of the invention described.

In operation, the use of a ball-size specific ball pod 515 substantially reduces the possibility of deploying the wrong size ball 550 since an improperly sized ball 550 will not be retained within a specified ball pod 515. A ball 550 that is too large will not fit within the bore of the ball pod 515, while a ball 550 that is too small will not be retained by the pod o-ring 525.

The ball pod and sleeve assembly 510 further has a pod cover 530 that is secured on the ball pod sleeve 520 and ball pod 515 using bolts 531 and retains the ball pod 515 and balls 550. The pod cover 530 is perforated so that pressure within the pod and outside the pod can be equalized. The pod cover 530 also has cover center hole 535 through which the balls 550 can be engaged by the ball launcher 225 to eject the ball 550 from the launcher. The pod cover 530 may also include one or more handles 536 to assist in removing the ball pod and sleeve assembly 510 from the ball pod housing 500.

Referring to FIGS. 3 and 4, the operation of the piston 620 to launch a ball 550 will now be described. As the piston 620 travels downward due to applied force (such as but not limited to hydraulic pressure, electrical motor) by a controller (described in FIGS. 5A and 5B), the attached ball rod 630 will also travel downward. As it travels downward, the ball rod 630 proceeds through the cover center hole 535 in the pod cover 530 and engages with the ball 550 retained by the pod o-ring 525. The ball rod 630 engages with the ball 550 to force the ball 550 past the pod o-ring 525 as it is compressed. The ball 550 is thereby ejected from the bottom of the ball pod 515. The ball rod seal gland 640 limits the downward travel range of the piston 620.

As the piston 620 is in its lower region of travel, a larger portion of the upper piston area 621 lowers into the hydraulic housing 610. As the piston 620 is in the upper region of travel, a larger portion of the upper piston area 621 will extend out of the hydraulic housing 610. The location of the piston 620 extending outside the hydraulic housing 610 indicates the position of the ball rod 630 with respect to the hydraulic housing chamber 612 and the ball pod 515. As a non-limiting example, the top portion of the upper piston area 621 can be a different color, e.g., red, than the remainder of the piston 620 to provide a visual indication of the status of the ball launcher 225. A user can visually discern the location of the piston 620 and attached ball rod 630 within the ball launcher 225 by noting the position of the upper piston area 621. In this way, the user can determine if the ball 550 have been ejected from the ball launcher 225. One of skill in the art will understand that visual indicators other than color can be utilized to show the relative location of the ball rod 630 within the hydraulic housing chamber 612 and remain within the scope of the present invention.

Figure 5A:
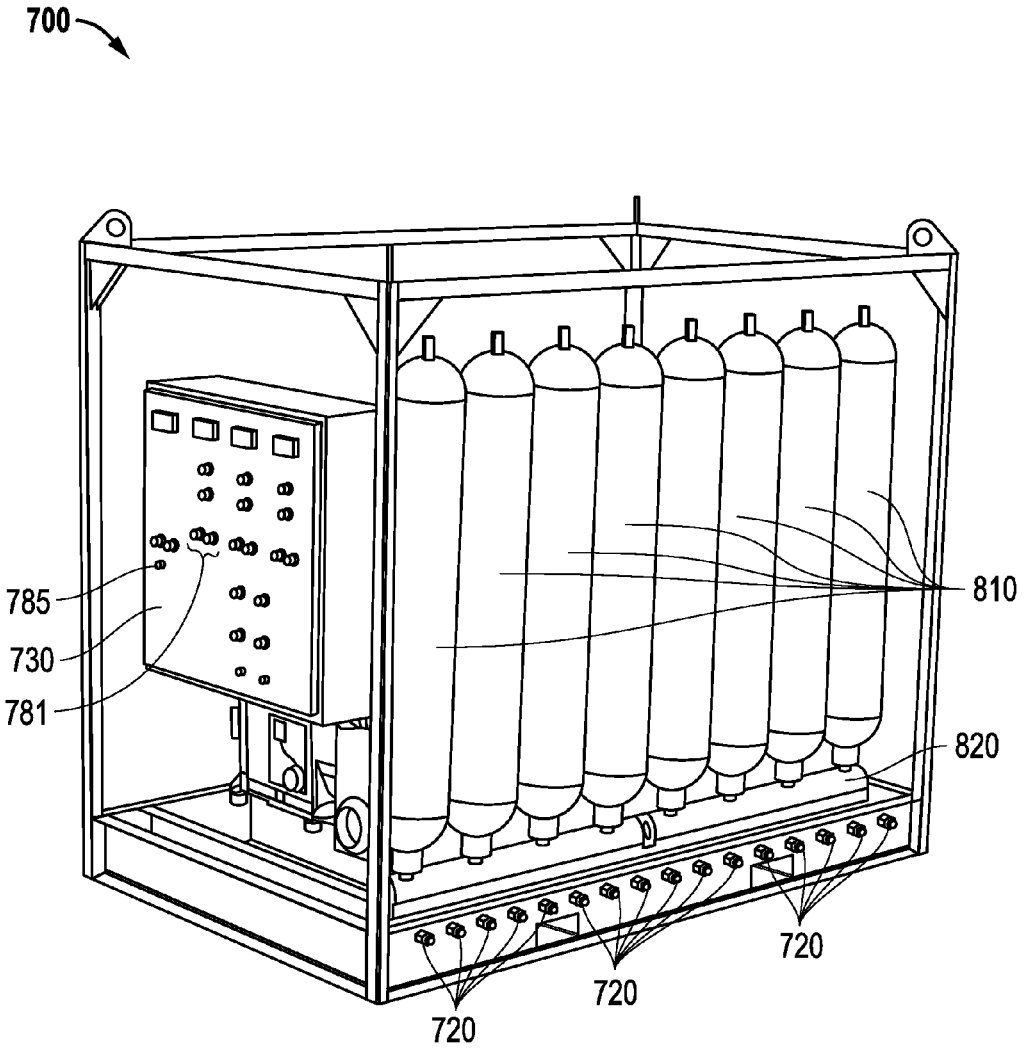
FIG. 5A illustrates a right side perspective view of a ball launcher control system used with the frac ball system and apparatus according to an embodiment of the invention.
Figure 5B:
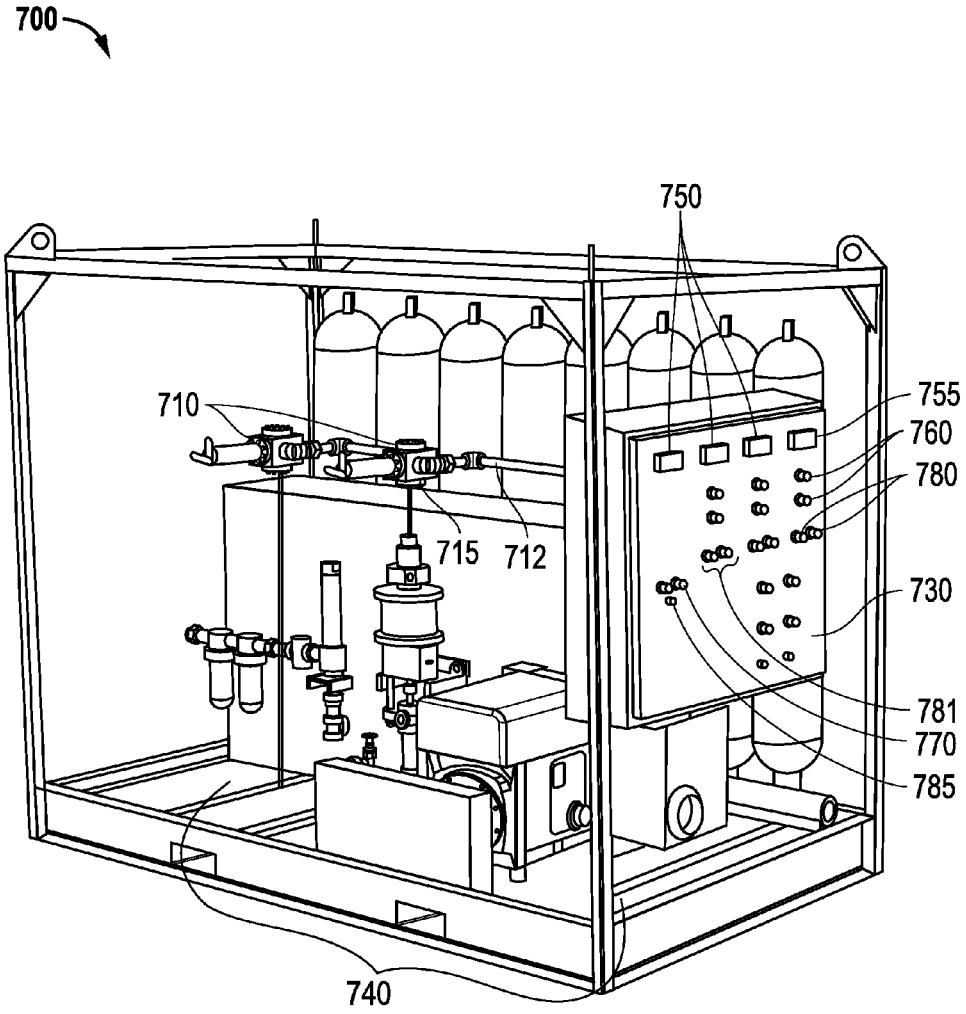
FIG. 5B illustrates a left side perspective view of a ball launcher control system used with the frac ball system and apparatus according to an embodiment of the invention.

Referring now to FIGS. 5A and 5B, the accumulator control unit 700 for use with frac ball launching unit 100 will be described together with the accumulator control unit 700 and the frac ball launcher unit 100 makes up a system of the invention. The accumulator control unit 700 provides actuation power and electronic control intelligence to the frac ball launching unit 100. The accumulator control unit 700 will be described herein as controlling remote isolation gate valve 120, ball launcher isolation gate valve 125, 135, 145, and tubing isolation gate valve 150 and ball launchers 225, 235, 245 on the remote unit 110. The accumulator control unit 700 can operate in an analogous fashion to control valves and ball launchers 325, 335, 345 on the well head unit 105.

The remote isolation gate valve 120, ball launcher isolation gate valves 125, 135, 145, and tubing isolation gate valve 150 can be manually operated or operated through a power source. One common but non-limiting example is the use of hydraulic power to operate these remote isolation gate valve 120, ball launcher isolation gate valves 125, 135, 145, and tubing isolation gate valve 150. The ball launchers 225, 235, 245, 325, 335, 345 as described above are also activated using hydraulic pressure. The accumulator control unit 700 manages the distribution of hydraulic pressure and controls the functions of the frac ball launching unit 100. One of skill in the art will recognize that an embodiment of the accumulator control unit 700 can include remote isolation gate valve 120, ball launcher isolation gate valves 125, 135, 145, and tubing isolation gate valve 150 that may be activated or controlled manually, hydraulically, or using alternative power sources.

In one embodiment, the accumulator control unit 700 consists of multiple fluid storage units 810 wherein a charge fluid, such as but not limited to, liquid-nitrogen, is used to pressurize the system. The accumulator control unit 700 also consists of a pumping system 740 to maintain the hydraulic pressure in the manifold 820 as required for the frac ball launching unit 100. In conventional fluid storage units 810, an inner bladder (not shown) separates the charge fluid from the hydraulic fluid, which is also stored under pressure within the fluid storage units 810. The fluid storage units 810 are threadably engaged in parallel to a manifold 820 so that the multiple fluid storage units 810 provide pressurized hydraulic fluid to the common manifold 820. The manifold 820 is further coupled to a pressure regulator 710 at a pressure regulator input side 712. The pressure regulator 710 further couples from the pressure regulator output side 715 to the solenoid valves (not shown). The pressure regulator 710 reduces the pressure of the hydraulic fluid from that in the manifold 820, such as but not limited to, 1500 pounds per square inch ("p.s.i."), to a working pressure, such as but not limited to, 300 p.s.i. In this way, the pressure regulator 710 controls the pressure of the hydraulic fluid that is subsequently used to operate various portions of the frac ball launching unit 100. Multiple pressure regulators can be used when needed, for example but not limited to if multiple pressures are required for various portions of the frac ball launching unit 100. As a non-limiting example, the ball launcher 225 can use a fluidic pressure of 300 p.s.i. while the ball launcher isolation gate valve 125 can use a fluidic pressure of 1500 p.s.i. If the manifold 820 is maintained at 1500 p.s.i., only one pressure regulator 710 is needed to reduce and regulate the pressure to 350 p.s.i. for the ball launcher 225. However, if the pressure in the manifold 820 is even higher, then a second pressure regulator 710 coupled to the manifold 820 can be used to regulate the pressure down to 1500 p.s.i. for the ball launcher isolation gate valve 125. One of skill in the art will understand that pressure regulators can be coupled and configured as needed to regulate the pressure for the accumulator control unit 700. One of skill in the art will also recognize that other ball launchers and gate valves can be controlled by an obvious extension of this embodiment. As a non-limiting example, when multiple ball launchers 225 are used, the various ball launchers 225 may require different pressures. In such a situation, multiple regulators with modified connectivity can be easily adapted to accomplish the required working pressures.

The pressure regulator 710 further couples the pressure regulator output side 715 through solenoid valves (not shown) to tie-in fittings 720. The pressure regulator output side 715 couples to the input side of the solenoid valve (not shown). The output side of the solenoid valve (not shown) couples to the tie-in fittings 720 which provide the connection point for hoses (not shown) to couple the tie-in fitting 720 to ports on the frac ball launching unit 100. The solenoid valve (not shown) allows electronic coupling to control the availability pressurized hydraulic fluid. Typically each tie-in fitting 720 has an associated solenoid valve (not shown) which controls when pressurized hydraulic fluid is available to the tie-in fitting 720.

The accumulator control unit 700 also has an electronic control unit 730 that incorporates circuitry to control the operation of the valves. The solenoid valve (not shown) is electronically coupled to the electronic control unit 730 and operates to allow pressurized hydraulic fluid to flow through the respective tie-in fitting 720, through the hose (not shown), to the appropriate port in the frac ball launching unit 100. Each tie-in fitting 720 couples to the appropriate portions of the frac ball launching unit 100 such as but not limited to the right port 650 and left port 660 of the ball launcher 225 or hydraulic port (not shown) of the remote isolation gate valve 120, ball launcher isolation gate valves 125, 135, 145, or tubing isolation gate valve 150. Thus, a particular solenoid valve (not shown) is coupled to each port of the frac ball launching unit 100 allowing the electronic control unit 730 to control the flow of hydraulic fluid to various ports of the frac ball launching unit 100. The solenoid valves (not shown) controls the flow of pressurized hydraulic fluid to the right port 650 and left port 660 of each ball launcher 225, 235, 245, 325, 335, 345 or the remote isolation gate valve 120, ball launcher isolation gate valves 125, 135, 145, and tubing isolation gate valve 150.

The accumulator control unit 700 further comprises sensors (not shown) which detect the hydraulic fluid pressure at each tie-in fitting 720 for the ball launcher 225, 235, 245, 325, 335, 345. The sensors (not shown) couple to launcher pressure gauges 750 on the electronic control unit 730 and provide a visual indication of the hydraulic pressure on the face of the electronic control unit 730. The sensors (not shown) also couple to electronic circuitry (not shown) of the electronic control unit 730 to detect the status of the ball launcher 225, such as but not limited to, when a ball 550 has been launched. The electronic control unit 730 also senses the fluid pressure at the manifold 820 and displays it on the face of the electronic control unit 730 at manifold pressure gauge 755. The electronic control unit 730 also comprises launcher inputs 760 on the face of the electronic control unit 730 so that a user can open the appropriate solenoid valve (not shown) to allow pressurized hydraulic fluid to flow through the respective tie-in fitting 720 to the appropriate port of the frac ball launching unit 100. The circuit inputs, by way of non-limiting example can consist of buttons that a user can utilize to control the status of remote isolation gate valve 120 and tubing isolation gate valve 150 and deploy balls 550 from the ball launchers 225, 235, 245.

The accumulator control unit 700 further comprises at least one control switch 781 and at least one safety switch 785 on the electronic control unit 730, wherein simultaneously depressing the control switch 781 and the safety switch 785 causes the piston assembly 615 to engage with the frac ball 550 to inject the frac ball 550 from the at least one ball launcher 225, 235, 245 into a well bore.

The accumulator control unit 700 and frac ball launching unit 100 provide two independent deployment verifications to ensure that balls 550 are not inadvertently launched. First, as mentioned above, the frac ball launching unit 100 has visual indicator that allow a user to recognize the status of each ball launcher 225, 235, 245, i.e., whether each ball launcher 225, 235, 245 has launched the balls 550 in to the fluid flow. When the piston 620 has bottomed out in the hydraulic housing chamber 612, the red-colored portion of the upper piston area 621 becomes visible in the window of the cage 695, indicating that the balls 550 have been launched.

Second, the accumulator control unit 700 utilizes a combination of electrical launcher inputs 760 and indicator lighting on those inputs that manage all of the hydraulic functions of the system. By way of non-limiting example, the indicator lighting can be integrated on the launcher input 760 so that the launcher input 760 change colors (e.g., red to green) when the electrical control system determines that appropriate remote isolation gate valve 120, ball launcher isolation gate valves 125, 135, 145, and tubing isolation gate valve 150, are open and a ball launcher 225 can properly launch a ball 550.

Referring collectively to FIGS. 1, 2, 3, 5A, and 5B, a typical operation of the frac ball launching unit 100 and the accumulator control unit 700 will now be described. The frac ball launching unit 100 and accumulator control unit 700 are typically set up at a pre-determined location. A designated pressure-pumping truck attaches applicable hard-pipe (not shown) to the cross-over fitting 270. The tubing isolation gate valve 150, present at the wellhead, is closed during this operation. The hydraulic housing 610 of the ball launcher 225, 235, 245 is removed to load the appropriate ball pod and sleeve assembly 510 with pre-determined balls 550. The hydraulic housing 610 is then reinstalled and the accumulator control unit 700 is tested to insure the integrity of the frac ball launching unit 100. In this test, while the tubing isolation gate valve 150 is closed, a hydrostatic shell test verification is performed per customer requirement by bringing the remote unit 110 and connection tubing 300 to a testing pressure to ensure they are pressure tight. The hydrostatic test pressure is then bled off to zero. The ball launcher isolation gate valves 125, 135, 145 are closed. The remote isolation gate valve 120 is closed.

The accumulator control unit 700 can be located remotely so that ball launching operations can be accomplished away from the well head unit 105 or remote unit 110. In this way, an operator is away from a danger zone area with large well pressures.

In one embodiment, once the frac ball launching unit 100 has been preloaded with the appropriate balls 550 and the system has been pretested, the indicator lights on the accumulator control unit 700 are illuminated red, indicating the system is ready for operation. The remote isolation gate valve 120 and tubing isolation gate valve 150 are actuated by depressing the valve control inputs 780. First, the remote isolation gate valve 120 is opened. A designated pressure pumping truck, which has attached applicable hard-pipe (not shown) to the cross-over fitting 270 begins the pumping process by supplying pumping fluid to the remote unit 110 and connection tubing 300. Once the pressure across tubing isolation gate valve 150 is equalized, the tubing isolation gate valve 150 is opened, and pump-down fluid flows into well bore. Once flow is established and verified, the appropriate ball launcher isolation gate valves 125, 135, 145 are open. A visual confirmation, e.g., a green light indicator, illuminates, indicating that valve is open. The electronic control unit 730 also senses that a ball 550 can be launched. At this point, the launcher input 760 can be depressed so that hydraulic fluid forces the piston 620 to travel downward until bottoming out in the hydraulic housing chamber 612, launching ball 550 into the flow-stream subsequently into the well. As an option, to prevent inadvertent launching, the electronic control unit 730 can be configured so that two inputs, a selector input 770 along with any valve control input 780 or launcher input 760 need to be simultaneously depressed to supply hydraulic pressure to certain ports on the frac ball launching unit 100. As a non-limiting example, the electronic control unit 730 can require the selector input 770 along with a launcher input 760 to be simultaneously depressed to launch a ball 550. A visual confirmation, e.g., a green light indicator, also illuminates, indicating actuation of the ball launcher 225, 235, 245 and deployment of the balls 550. Injected ball 550 travels down the well-bore until mating with corresponding seat(s). Operators can confirm that the launch function was successful by monitoring spikes in pumping pressure. Once confirmed, the system is isolated by returning all valves in the frac ball launching unit 100 to their normally closed position. A red light confirmation can indicate this configuration. These steps can be repeated as required to complete the job. The ball launchers 225, 235, 245 will typically utilize a variety of ball 550 sizes where the smallest balls 550 are first launched while the larger balls 550 are launched later. In this way, the ball launching is performed by engaging specific, designated launcher inputs 760, selector inputs 770, and valve control inputs 780 on the control console in a sequential operation by a designed series of electric solenoid valves (not shown), preventing accidental actuation or deployment.

The frac ball launching unit 100 and accumulator control unit 700 are used in various multi-stage well stimulation and completions systems that utilize a multiple number and multiple size balls 550 to facilitate the movement of downhole packers and isolation seal assemblies installed in the well-bore. All major components of the frac ball launching unit 100 and accumulator control unit 700 are manufactured per API 6A standards and rated to full working pressure. The accumulator control unit 700 can incorporate a battery backup in the even the primary power source is lost. The frac ball launching unit 100 and accumulator control unit 700 are modular in design, enhancing serviceability and giving the operator the capability of adding additional launch stations to meet the architecture requirements of the well stimulation/completion.

While the terms "ball" and "frac-ball" have been used herein, one of skill in the art will understand that a plug or projectiles of other shapes can be used with embodiments of the invention. Further, one of skill in the art will recognize that this invention is not limited to the fracturing operation. As a non-limiting example, isolation of portion of the well is also useful in the casing operation.

It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention.

What is claimed is:

1. A ball pod apparatus comprising:
- a ball pod sleeve having an axial sleeve bore;
- a ball pod disposed within the axial sleeve bore and having a cylindrical ball pod bore;
- a ball pod cover removably attached to the ball pod sleeve; and
- a retainer within the cylindrical ball pod bore, wherein the retainer is an o-ring within an inner groove of the ball pod, wherein the retainer prevents undesired gravity exit of a frac ball from the ball pod apparatus.

2. The ball pod apparatus as in claim 1 wherein the ball pod cover has a central hole to allow mechanical engagement of a piston with a frac ball when retained within the ball pod.

3. The ball pod apparatus as in claim 1 wherein the axial sleeve bore is cylindrical.

4. A frac ball launching apparatus for injecting a frac ball into well piping comprising:
- a ball pod housing having a ball pod bore;
- a ball pod apparatus comprising:
  - a ball pod sleeve having an axial sleeve bore;
  - a ball pod adapted to retain a frac ball, wherein the ball pod is disposed within the axial sleeve bore and wherein the ball pod apparatus is disposed within the ball pod bore; and
- a hydraulic housing removably engaged with the ball pod housing comprising:
  - a piston assembly operationally disposed within the hydraulic housing; and a passage for the piston assembly to travel within the hydraulic housing wherein the piston assembly is adapted to engage with the frac ball to inject the frac ball from the frac ball launching apparatus into the well piping.

5. The frac ball launching apparatus as in claim 4 wherein hydraulic pressure causes the piston assembly to travel within the passage.

6. The frac ball launching apparatus as in claim 4 wherein the ball pod is adapted to retain multiple frac balls and the piston assembly is adapted to engage with the multiple frac balls to inject the multiple frac balls from the frac ball launching apparatus into the well piping in one executed operation.

7. The frac ball launching apparatus as in claim 6 wherein the multiple frac balls have a substantially similar diameter.

8. The frac ball launching apparatus as in claim 4 further comprising a central hole in the hydraulic housing through which the piston assembly may travel to indicate its position relative to the passage.

9. A method of configuring a frac ball launching apparatus comprising:

providing at least one ball launcher comprising:

a ball pod housing having a ball pod bore;

a ball pod apparatus comprising:

a ball pod sleeve having a sleeve bore; and a first ball pod adapted to retain a frac ball of a first diameter wherein the ball pod is disposed within the sleeve bore, wherein the ball pod apparatus is disposed within the ball pod bore; and providing a second ball pod adapted to retain a frac ball of a second diameter wherein the second diameter can be the same or different from the first diameter;

removing the first ball pod disposed within the sleeve bore; and inserting the second ball pod within the sleeve bore.

10. A frac ball launching system for injecting balls into a well bore comprising:

at least one ball launcher comprising:

a ball pod housing having a ball pod bore;

a ball pod apparatus comprising:

a ball pod sleeve having an axial sleeve bore; and a ball pod adapted to retain a frac ball wherein the ball pod is disposed within the axial sleeve bore, wherein the ball pod apparatus is disposed within the ball pod bore; and a hydraulic housing removably engaged with the ball pod housing comprising:

a piston assembly operationally disposed within the hydraulic housing; and a passage for the piston assembly to travel within the hydraulic housing; and a frac ball control system comprising at least one control switch, wherein activation of the control switch causes the piston assembly to engage the frac ball to inject the frac ball from the at least one ball launcher into the well bore.

11. A frac ball launching system for injecting balls into a well bore comprising:

at least one ball launcher comprising:

a ball pod housing having a ball pod bore;

a ball pod apparatus comprising:

a ball pod sleeve having an axial sleeve bore; and a ball pod adapted to retain a frac ball wherein the ball pod is disposed within the axial sleeve bore wherein the ball pod apparatus is disposed within the ball pod bore; and a hydraulic housing removably engaged with the ball pod housing comprising:

a piston assembly operationally disposed within the hydraulic housing; and a passage for the piston assembly to travel within the hydraulic housing; and a frac ball control system comprising:

at least one control switch; and at least one safety switch wherein simultaneously depressing the control switch and the safety switch causes the piston assembly to engage with a frac ball to inject the frac ball from the at least one ball launcher into the well bore.

12. The frac ball launching system as in claim 11 wherein activating the control switch causes hydraulic pressure to translate a piston assembly to engage with a frac ball to inject the frac ball from the at least one ball launcher into the well bore.

13. The frac ball launching system as in claim 11 wherein the frac ball control system is located remote to the at least one ball launcher.

14. The frac ball launching system as in claim 11 wherein the at least one ball launcher is located essentially at the well bore.

15. The frac ball launching system as in claim 11 additionally comprising a connection tube to place the at least one ball launcher remote to the well bore.

16. The frac ball launching system as in claim 11 comprising multiple ball launchers.

17. The frac ball launching system as in claim 16 additionally comprising a connection tube to place the multiple ball launchers remote to the well bore.

18. A method of injecting frac balls into a flow passage comprising:

providing at least one ball launcher comprising:

a ball pod housing having a ball pod bore;

a ball pod apparatus comprising:

a ball pod sleeve having a sleeve bore; and a ball pod adapted to retain a frac ball wherein the ball pod is disposed within the sleeve bore, wherein the ball pod apparatus is disposed within the ball pod bore; and a hydraulic housing removably engaged with the ball pod housing comprising:

a piston assembly operationally disposed within the hydraulic housing; and a passage for the piston assembly to travel within the hydraulic housing; and providing a frac ball control system comprising at least one control switch; and activating at least the control switch to cause the piston assembly to engage with the frac ball to inject the frac ball from the at least one ball launcher into the flow passage.

19. The method of injecting frac balls as in claim 18 further comprising the step of providing a safety switch in the frac ball control system and simultaneously activating the safety switch with the control switch to cause the piston assembly to engage with the frac ball to inject the frac ball from the frac ball launching apparatus into the flow passage.

* * * * *